US008737856B2

(12) United States Patent
Terada

(10) Patent No.: US 8,737,856 B2
(45) Date of Patent: May 27, 2014

(54) IMAGE FORMING APPARATUS WITH CONTROL FOR TEST PRINTING, AND RELATED IMAGE FORMING METHOD AND A COMPUTER-READABLE MEDIUM HAVING COMPUTER-EXECUTABLE INSTRUCTIONS

(75) Inventor: Kyosuke Terada, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 326 days.

(21) Appl. No.: 13/230,297

(22) Filed: Sep. 12, 2011

(65) Prior Publication Data

US 2012/0082471 A1 Apr. 5, 2012

Related U.S. Application Data

(60) Provisional application No. 61/389,704, filed on Oct. 4, 2010.

(51) Int. Cl.
*G03G 15/08* (2006.01)

(52) U.S. Cl.
USPC ..... 399/53; 399/54; 399/81; 399/223; 399/228

(58) Field of Classification Search
USPC ..... 399/8, 53, 54, 81, 82, 223, 228
See application file for complete search history.

(56) References Cited

U.S. PATENT DOCUMENTS

| | | | | |
|---|---|---|---|---|
| 5,394,231 | A * | 2/1995 | Sudo et al. | 399/228 |
| 7,283,758 | B2 * | 10/2007 | Murakami | 399/82 |
| 2008/0003019 | A1 | 1/2008 | Kikuchi | |
| 2008/0145087 | A1 | 6/2008 | Itou | |
| 2009/0190143 | A1 | 7/2009 | Matsumoto | |

FOREIGN PATENT DOCUMENTS

| | | |
|---|---|---|
| JP | 6059542 | 3/1994 |
| JP | 2002-240403 | 8/2002 |

OTHER PUBLICATIONS

Office Action dated Feb. 7, 2014, filed in corresponding Chinese Patent Application No. 201110281507.5, with English translation.

* cited by examiner

*Primary Examiner* — William J Royer
(74) *Attorney, Agent, or Firm* — Patterson & Sheridan, L.L.P.

(57) ABSTRACT

An image forming apparatus includes an image forming part to form an image with one of a color unerasable developer and a color erasable developer, and a control part to automatically select the color erasable developer when test printing is selected.

20 Claims, 9 Drawing Sheets

IMAGE FORMING APPARATUS WITH CONTROL FOR TEST PRINTING, AND RELATED IMAGE FORMING METHOD AND A COMPUTER-READABLE MEDIUM HAVING COMPUTER-EXECUTABLE INSTRUCTIONS

CROSS-REFERENCE TO RELATED APPLICATIONS

This application is based upon and claims the benefit of priority from prior U.S. Patent Application No. 61/389,704, filed on Oct. 4, 2010, and the entire contents of which are incorporated herein by reference.

FIELD

Embodiments described herein relate generally to an image forming apparatus, an image forming method and a computer-readable medium having computer-executable instructions.

BACKGROUND

When an image is formed by an image forming apparatus, test printing is performed in order to confirm whether an image is formed in an intended mode.

However, when a normal developer is used for the test printing, a recording medium used for the test printing must be discarded and can not be reused.

In recent years, from the demand for resource saving, an image forming apparatus in which an image is formed with a color erasable developer is introduced.

Accordingly, when the color erasable developer is used for the test printing, the recording medium used for the test printing can be reused.

However, not all users use the color erasable developer for the test printing. Besides, even if the color erasable developer is tried to be used for the test printing, an image is formed with a normal developer by an operation miss.

Accordingly, an image forming apparatus is required in which when test printing is performed, the user is urged to use the color erasable developer more certainly.

DETAILED DESCRIPTION

Throughout this description, the embodiments and examples shown should be considered as exemplars, rather than limitations on the apparatus and methods of the present invention.

Hereinafter, an image forming apparatus, an image forming method and a computer-readable medium having computer-executable instructions according to exemplary embodiments will be described in detail with reference to the drawings. Here, the image forming apparatus includes a copying machine, an MFP (Multifunction Peripheral) and a printer.

Figure 1:
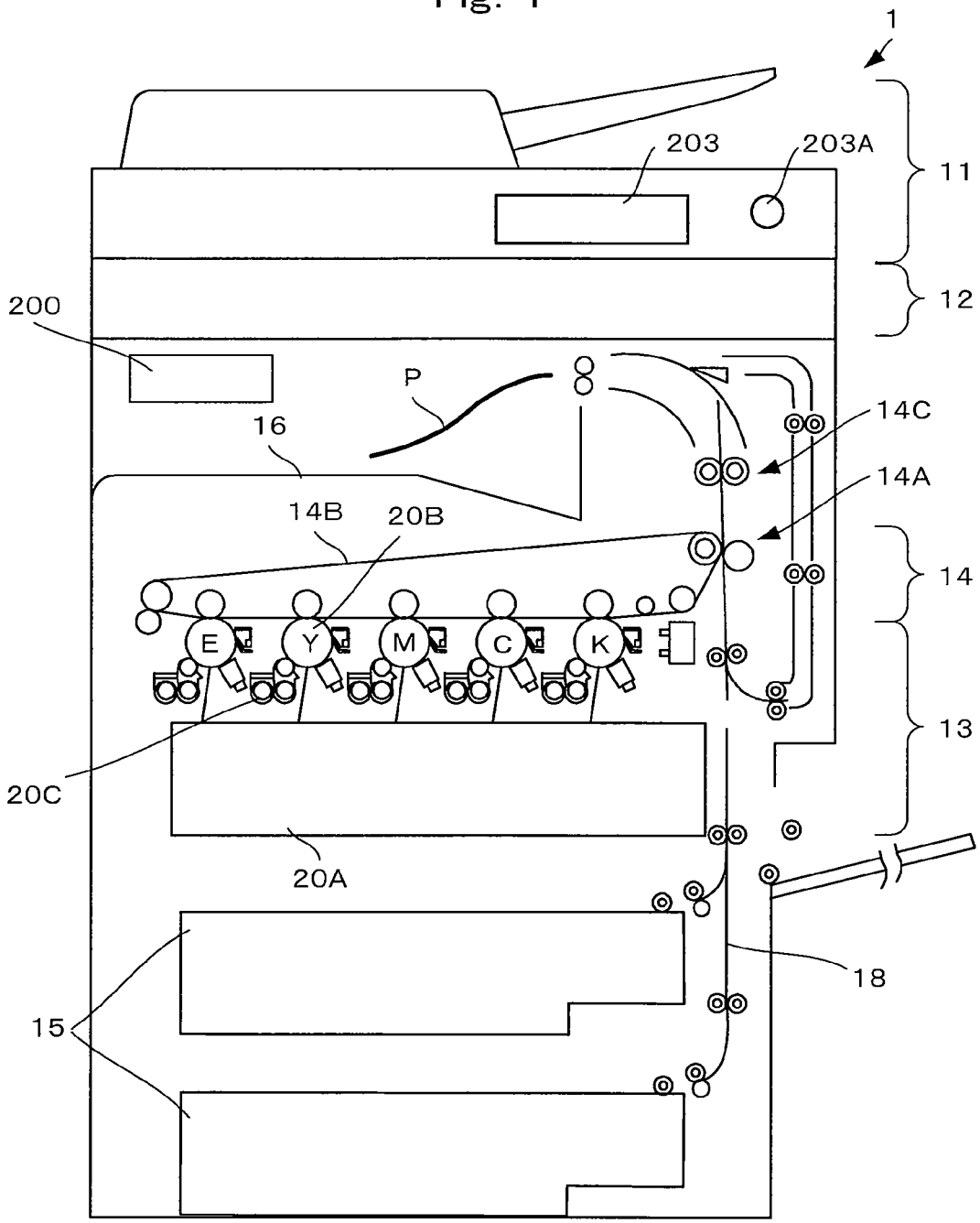
FIG. 1 is a view showing a structure of an image forming apparatus.

FIG. 1 is a view showing a structure of an image forming apparatus 1 of an embodiment. As shown in FIG. 1, the image forming apparatus 1 includes a control part 200, a control panel 203, a start button 203A, an auto document feeder 11, an image reading part 12, an image forming part 13, a transfer part 14, a sheet conveyance mechanism 18 and a paper feed unit 15.

The control panel 203 includes a touch panel as an input and output part to display, for example, a graphical user interface.

When the start button 203A is depressed, a signal indicating that image formation is started is transmitted to the control part 200.

The auto document feeder 11 is openably and closably provided at an upper part of a main body of the image forming apparatus 1. The auto document feeder 11 includes a document conveyance mechanism 18 that takes out a document one by one from a paper feed tray and conveys the document to a paper discharge tray.

The auto document feeder 11 conveys the document one by one to a document reading part of the image reading part 12 by a document conveyance function. Besides, the auto document feeder 11 is opened and a document can be placed on a document table of the image reading part 12.

The image reading part 12 includes a carriage including an exposure lamp to expose a document and a first reflecting mirror, plural second reflecting mirrors moving in accordance with the movement of the carriage, a lens block, and a CCD (Charge Coupled Device) of an image reading sensor.

The carriage stands still at the document reading part or reciprocates below the document table, and the light of the exposure lamp reflected by the document is reflected by the first reflecting mirror. The plural second reflecting mirrors reflect the reflected light of the first reflecting mirror to the lens block. The lens block changes the magnification of the reflected light, and outputs the light to the CCD. The CCD converts the incident light into an electric signal, and outputs the signal as an image signal to the image forming part 13.

The image forming part 13 includes a laser irradiation unit 20A, a photoconductive drum 20B as an electrostatic latent image carrier, and a developer supply unit 20C for each of yellow Y, magenta M, cyan C, black K and color erasable developer E.

The color erasable developer includes a coloring compound, color developing agent, and color erasing agent. The coloring compound is, for example, leuco dye. The color developing agent is, for example, phenols. The color erasing agent is, for example, a material which is compatible with the coloring compound when heated, and has no affinity with the color developing agent.

The color erasable developer develops color by the interaction between the coloring compound and the color developing agent, and the color is erased by heating at a temperature higher than a color erasing temperature since the interaction between the coloring compound and the color developing agent is lost.

The laser irradiation unit 20A irradiates laser light to the photoconductive drum 20B based on an image signal, and forms an electrostatic latent image on the photoconductive drum 20B. The developer supply unit 20C supplies a developer to the photoconductive drum 20B and forms a developer image from the electrostatic latent image.

The paper feed unit 15 takes out a recording medium P one by one from a paper feed cassette and delivers the recording medium P to the sheet conveyance mechanism 18. The sheet conveyance mechanism 18 conveys the recording medium P to the transfer part 14.

The transfer part 14 includes a transfer belt 14B and a transfer roller 14A. The transfer belt 14B as an image carrier transfers the developer image on the photoconductive drum 20B and carries the developer image. The transfer roller 14A applies a voltage and transfers the developer image on the transfer belt 14B to the conveyed recording medium P.

The image forming apparatus 1 includes a fixing device 14C at the downstream side of the transfer part 14 in the recording medium conveyance direction. The fixing device 14C heats, presses and fixes the developer image to the recording medium P.

The recording medium P discharged from a paper discharge port is stacked on a paper discharge tray 16 as a carrying part to carry the recording medium P.

Figure 2:
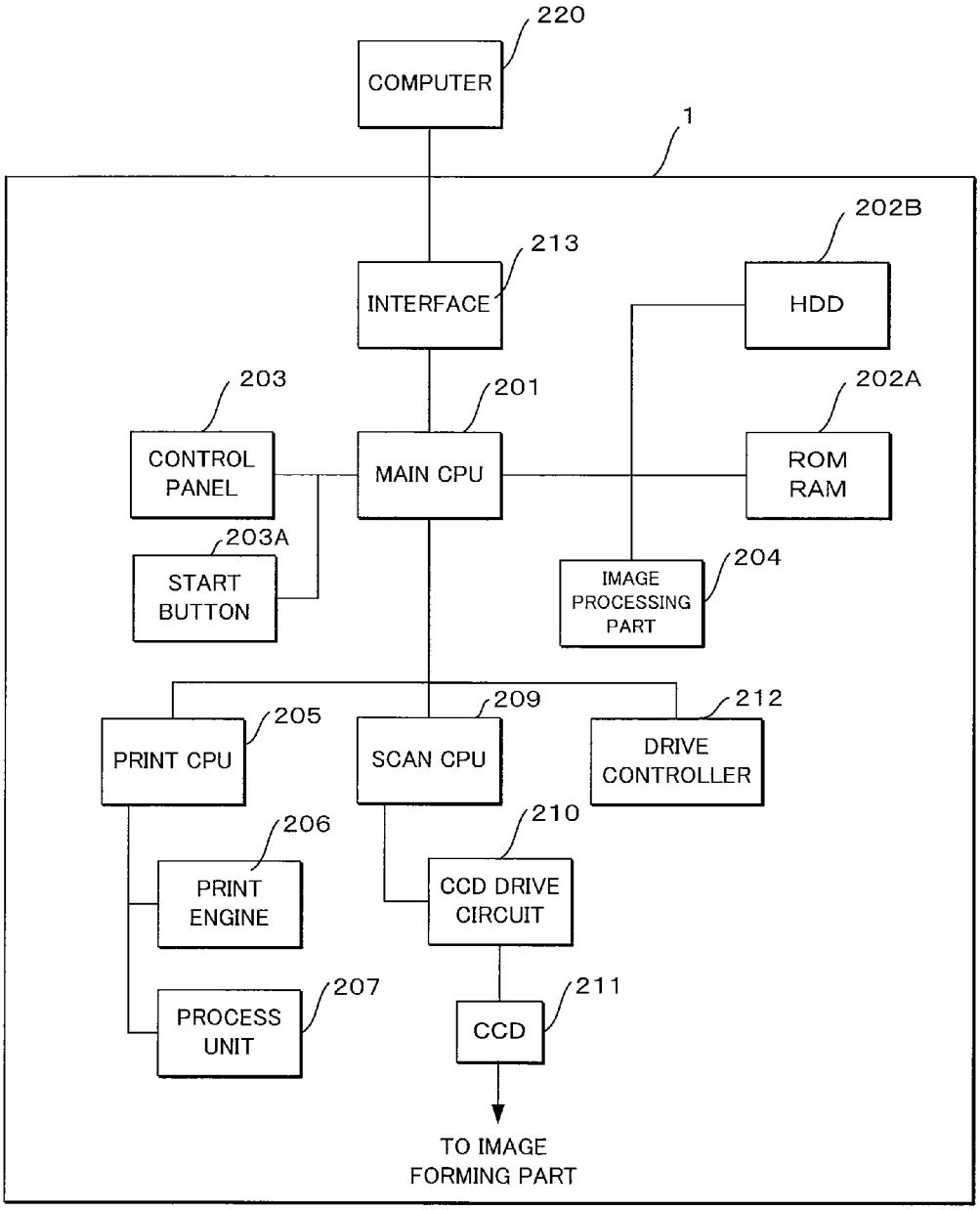
FIG. 2 is a block diagram showing the structure of the image forming apparatus.

FIG. 2 is a block diagram showing a structure of the image forming apparatus 1. As shown in FIG. 2, the image forming apparatus 1 includes a main CPU 201 as an arithmetic unit of the control part 200 to overall control the whole image forming apparatus 1, the control panel 203 connected to the main CPU 201, a ROM and RAM 202A as a storage device, a hard disk drive (hereinafter referred to as HDD) 202B, the start button 203A, and an image processing part 204 to perform image processing.

The storage device 202A as a computer-readable medium stores computer-executable instructions. The main CPU 201 reads the computer-executable instructions from the storage device 202A and executes the instructions.

The type of the computer-readable medium is arbitrary as long as the computer-executable instructions can be stored. The computer-readable medium is, for example, a flexible disk, a magnetic tape, a magnetic disk, a flash memory, a ROM, a RAM or the like, and is not limited to these.

The main CPU 201 is connected to a computer 220 as an external apparatus through an interface 213. Besides, the main CPU 201 is connected to a print CPU 205 to control respective parts of an image forming system, a scan CPU 209 to control respective parts of an image reading system, and a drive controller 212 to control a drive part.

The print CPU 205 controls a print engine 206 to form an electrostatic latent image on the photoconductive drum 20B, and a process unit 207 to form a developer image.

The scan CPU 209 controls a CCD drive circuit 210 to drive a CCD 211. A signal from the CCD 211 is outputted to the image forming part 13.

Figure 3:
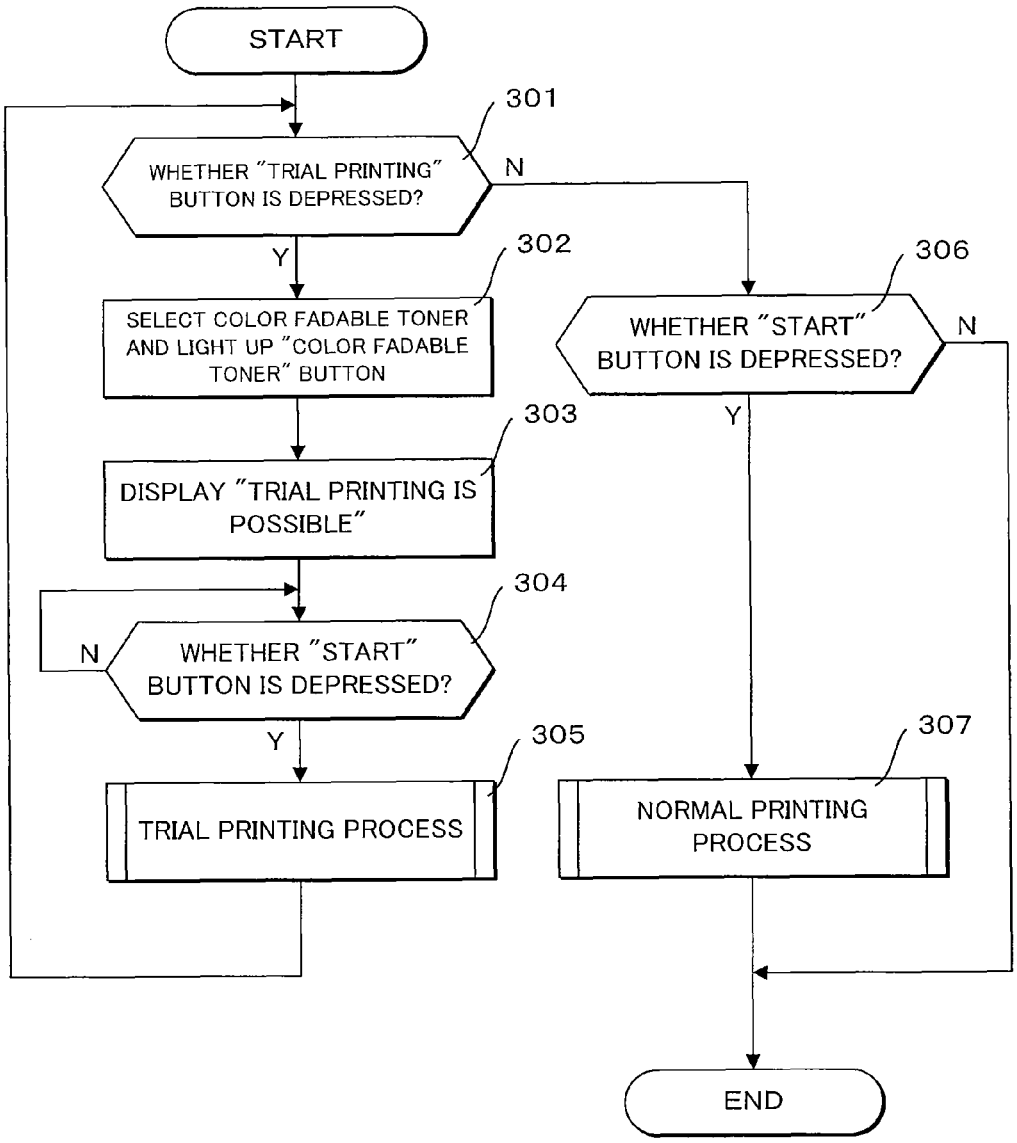
FIG. 3 is a flowchart showing an operation of the image forming apparatus.

FIG. 3 is a flowchart showing the operation of the image forming apparatus 1. As shown in FIG. 3, at Act 301, the control part 200 determines whether a "trial printing" button displayed on the control panel 203 is depressed. When the control part 200 determines that the "test printing" button is depressed, advance is made to Act 302, and when the control part 200 determines that the button is not depressed, advance is made to Act 306.

At Act 302, the control part 200 automatically selects a color fadable toner as a color erasable developer, and causes a "color fadable toner" button of the control panel 203 to light up.

At Act 303, the control part 200 displays, on the control panel 203, "Trial printing is possible" as a display to indicate that the test printing can be performed.

At Act 304, the control part 200 determines whether the start button 203A is depressed. When the control part 200 determines that the start button 203A is depressed, advance is made to Act 305, and when the control part 200 determines that the start button is not depressed, return is made to Act 304.

At Act 305, the image forming apparatus 1 performs the trial printing process as the test printing process, and return is made to Act 301.

At Act 306, the control part 200 determines whether the start button 203A is depressed. When the control part 200 determines that the start button 203A is depressed, advance is made to Act 307, and when the control part 200 determines that the start button is not depressed, the process is ended.

At Act 307, the image forming apparatus 1 performs a normal printing process and ends the process.

Figure 4:
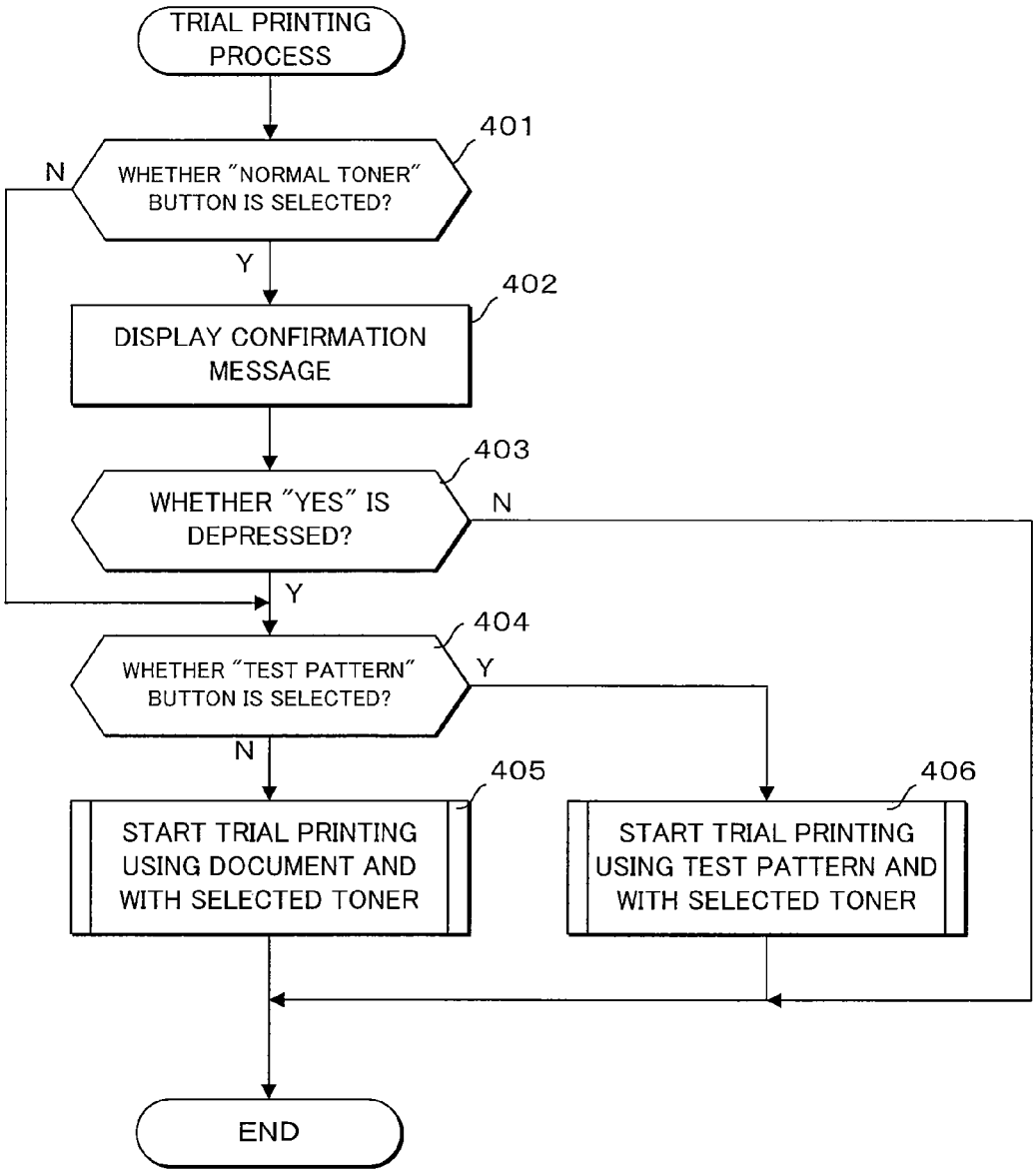
FIG. 4 is a flowchart showing an operation of a trial printing process of the image forming apparatus.

FIG. 4 is a flowchart showing the operation of the trial printing process of the image forming apparatus 1 corresponding to Act 305 of FIG. 3. As shown in FIG. 4, at Act 401, the control part 200 determines whether selection is changed by the user from the "color fadable toner" button automatically set at Act 302 to a "normal toner" button to select that an image is formed with a normal toner as a color unerasable developer. When the control part 200 determines that the "normal toner" button is selected, advance is made to Act 402, and when the control part 200 determines that the "normal toner" button is not selected, advance is made to Act 404.

At Act 402, the control part 200 displays, on the control panel 203, a confirmation message for confirming that an image is formed with the normal toner.

At Act 403, the control part 200 determines whether a "YES" button is depressed. When the control part 200 determines that the "YES" button is depressed, advance is made to ACT 404, and when the control part 200 determines that the "YES" button is not depressed, the trial printing process is ended.

As described above, after the determination is made as to whether the trial printing is performed with the automatically set color fadable toner or the normal toner, at Act 404, the control part 200 determines whether a "test pattern" button indicating that test printing is performed with a test pattern stored in the storage device 202A is selected. When the control part 200 determines that the "test pattern" button is selected, advance is made to Act 406, and when the control part 200 determines that the "test pattern" button is not selected, advance is made to Act 405.

At Act 405, the control part 200 starts the trail printing using a document and with the toner selected between the "color fadable toner" and the "normal toner".

At Act 406, the control part 200 reads the test pattern from the storage device 202A, and starts the trial printing using the test pattern and with the toner selected between the "color fadable toner" and the "normal toner".

The laser irradiation unit 20A of the color erasable developer E irradiates laser light to the photoconductive drum 20B, and the laser irradiation unit 20A of the color unerasable developer does not irradiate laser light to the photoconductive drum 20B, so that the image forming apparatus 1 performs the image formation using the color unerasable developer.

Figure 5:
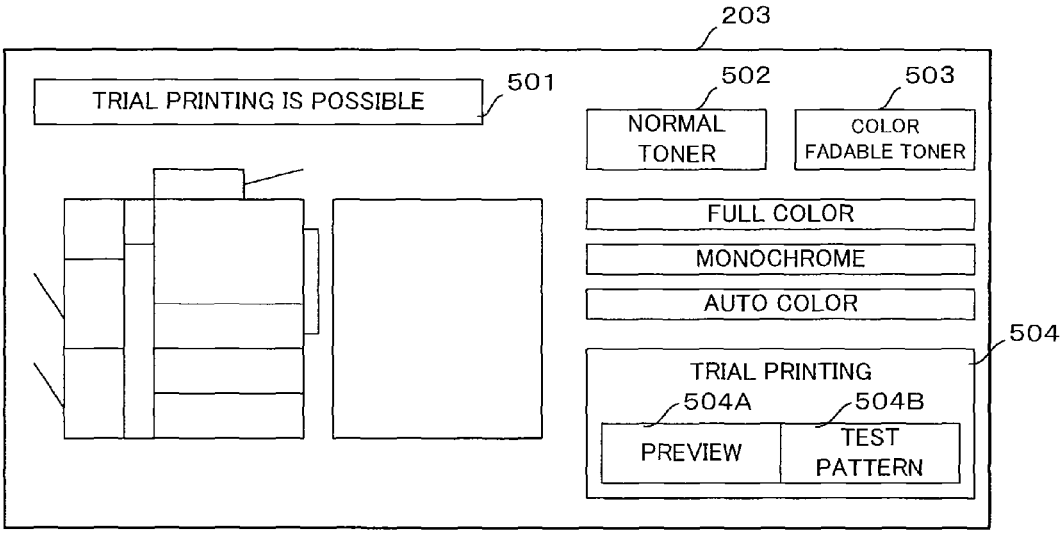
FIG. 5 is a view showing an example of a screen displayed on a control panel by the image forming apparatus.

FIG. 5 is a view showing an example of a screen displayed on the control panel 203 by the image forming apparatus 1. As shown in FIG. 5, the image forming apparatus 1 displays, on the control panel 203, a "Trial printing is possible" display 501, a "normal toner" button 502 and a "color fadable toner" button 503 which are for selecting a developer, and a "trial printing" button 504 for performing test printing.

The "trial printing" button 504 may include a "preview" button 504A for performing current preview, and a "test pattern" button 504B for selecting the test printing using the test pattern.

Figure 6:
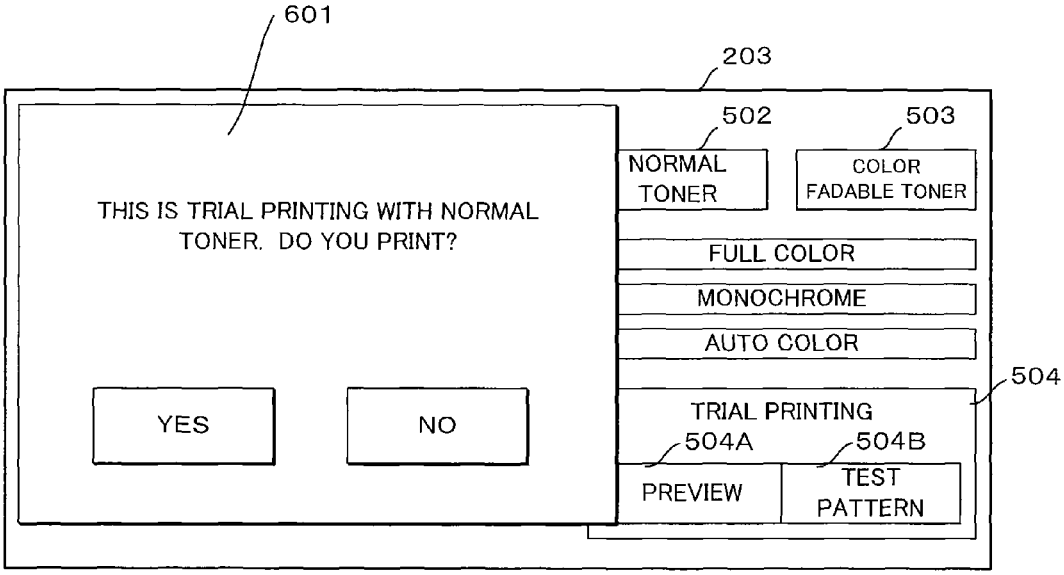
FIG. 6 is a view showing an example of a confirmation message displayed on the control panel by the image forming apparatus.

FIG. 6 is a view showing an example of a confirmation message 601 displayed on the control panel 203 by the image forming apparatus 1. As shown in FIG. 6, the image forming apparatus 1 displays, on the control panel 203, a "YES" button, a "NO" button, and "This is trial printing with normal toner. Do you print?" as the confirmation message 601 to confirm whether the execution of the test printing with the color unerasable developer is allowed.

Figure 7:
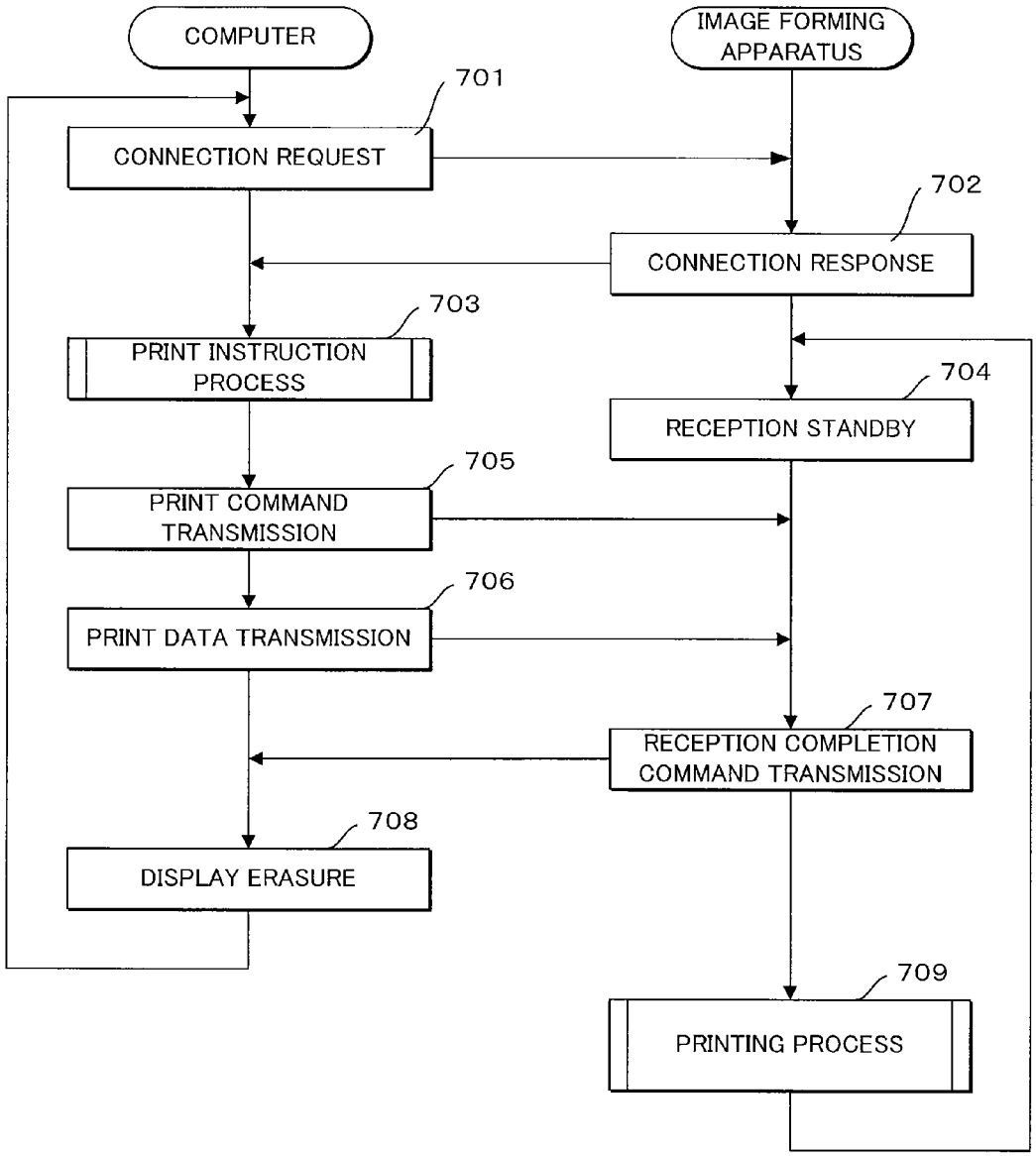
FIG. 7 is a flowchart showing an operation when the image forming apparatus is connected to a computer.

FIG. 7 is a flowchart showing an operation when the image forming apparatus 1 is connected to the computer 220.

The computer 220 includes an arithmetic unit, a storage device, an input and output device and a communication interface. The computer 220 stores computer-executable instructions as a printer driver in the storage device. The computer 220 reads and executes the printer driver from the storage device.

At Act 701, the computer 220 transmits a connection request to the image forming apparatus 1.

At Act 702, the image forming apparatus 1 transmits a connection response to the computer 220.

At Act 703, the computer 220 executes a print instruction process.

At Act 704, the image forming apparatus 1 waits for reception of an instruction from the computer 220.

At Act 705, the computer 220 transmits a print command to the image forming apparatus 1.

At Act 706, the computer 220 transmits print data to the image forming apparatus 1.

At Act 707, the image forming apparatus 1 transmits a reception completion command to the computer 220 after reception completion.

At Act 708, the computer 220-erases the screen displayed on the display of the input and output device and return is made to Act 701.

At Act 709, the image forming apparatus 1 starts a printing process, and return is made to Act 704 after the end of the printing process.

Figure 8:
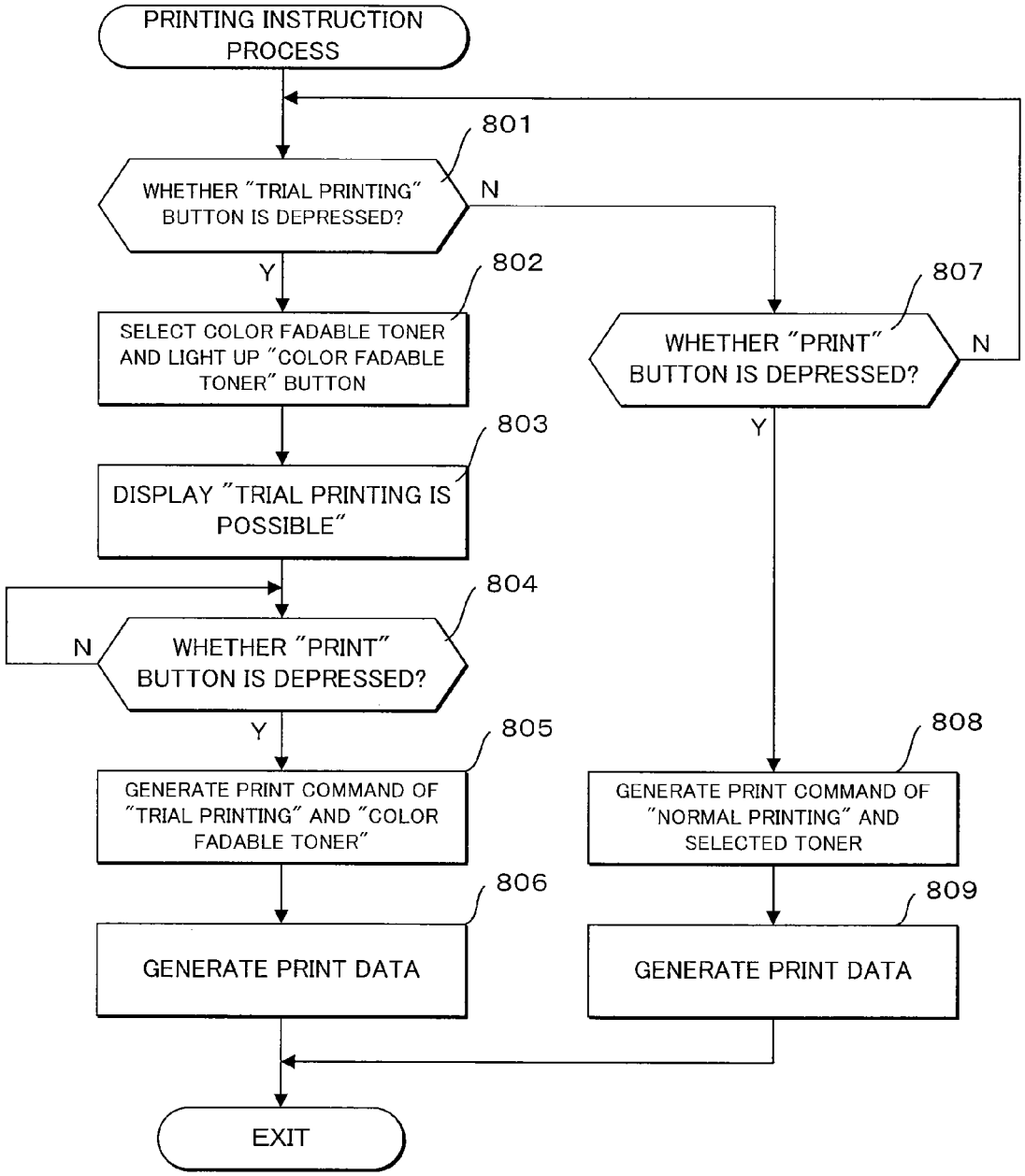
FIG. 8 is a flowchart showing a print instruction process of the computer.

FIG. 8 is a flowchart showing the print instruction process of the computer 220. As shown in FIG. 8, at Act 801, the computer 220 determines whether the "trial printing" button is depressed. When the computer 220 determines that the "trial printing" button is depressed, advance is made to Act 802, and when the computer 220 determines that the "trial printing" button is not depressed, advance is made to Act 807.

At Act 802, the computer 220 automatically selects the color fadable toner, and causes the "color fadable toner" button of the display to light up.

At Act 803, the computer 220 displays "Trial printing is possible" on the display.

At Act 804, the computer 220 determines whether the "PRINT" button is depressed. When the computer 220 determines that the "PRINT" button is depressed, advance is made to Act 805, and when the computer 220 determines that the "PRINT" button is not depressed, return is made to Act 804.

At Act 805, the computer 220 generates a print command indicating "trial printing" and "color fadable toner".

At Act 806, the computer 220 generates the print data and exits the print instruction process.

At Act 807, the computer 220 determines whether the "PRINT" button is depressed. When the computer 220 determines that the "PRINT" button is depressed, advance is made to Act 808, and when the computer 220 determines that the "PRINT" button is not depressed, return is made to Act 801.

At Act 808, the computer 220 generates a print command indicating "normal printing" and toner selected between "color fadable toner" and "normal toner".

At Act 809, the computer 220 generates the print data and exits the print instruction process.

Figure 9:
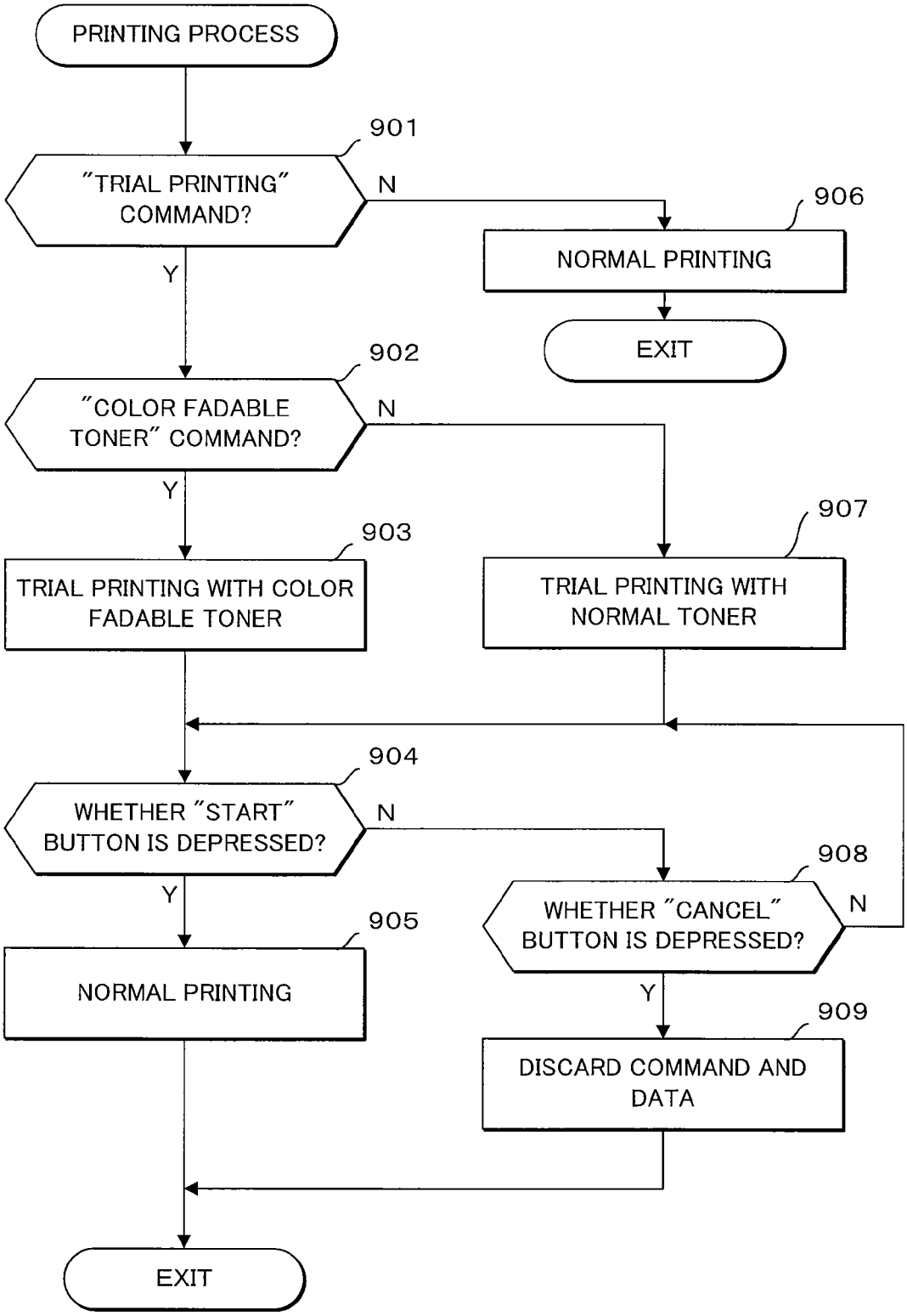
FIG. 9 is a flowchart showing a printing process of the image forming apparatus.

FIG. 9 is a flowchart showing the printing process of the image forming apparatus 1. As shown in FIG. 9, at Act 901, the control part 200 determines whether a "trial printing" command is received. When the control part 200 determines that the "trial printing" command is received, advance is made to Act 902, and when the control part 200 determines that the "trial printing" command is not received, advance is made to Act 906.

At Act 902, the control part 200 determines whether a "color fadable toner" command is received. When the control part 200 determines that the "color fadable toner" command is received, advance is made to Act 903, and when the control part 200 determines that the "color fadable toner" command is not received, advance is made to Act 907.

At Act 903, the control part 200 performs the trial printing as the test printing with the color fadable toner.

At Act 904, the control part 200 determines whether the start button 203A is depressed. When the control part 200 determines that the start button 203A is depressed, advance is made to Act 905, and when the control part 200 determines that the start button 203A is not depressed, advance is made to Act 908.

At Act 905, the image forming apparatus 1 performs the normal printing, and ends the printing process.

At Act 906, the image forming apparatus 1 performs the normal printing and ends the printing process.

At Act 907, the image forming apparatus 1 performs the trial printing with the normal toner and advance is made to Act 904.

At Act 908, the control part 200 determines whether a "CANCEL" button is depressed. When the control part 200 determines that the "CANCEL" button is depressed, advance is made to Act 909, and when the control part 200 determines that the "CANCEL" button is not depressed, return is made to Act 904.

At Act 909, the image forming apparatus 1 discards the received command and print data and ends the printing process.

Figure 10:
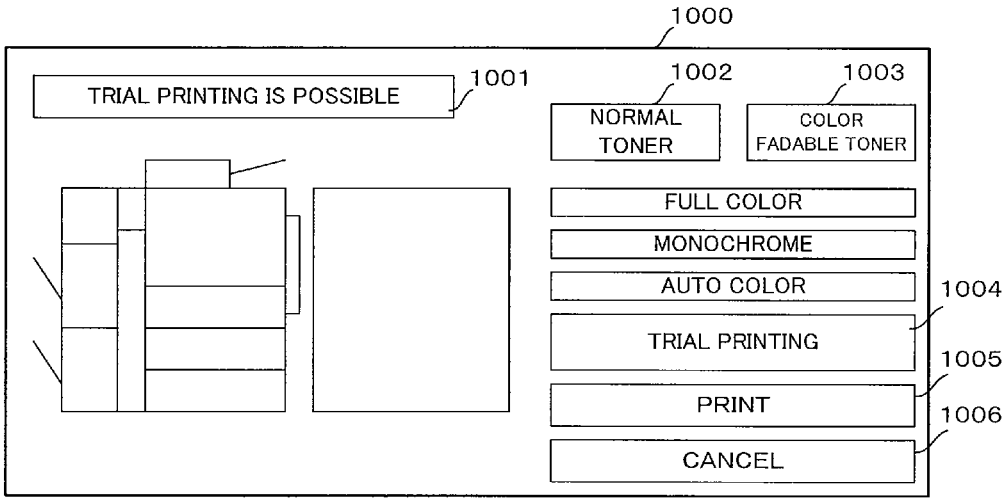
FIG. 10 is a view showing an example of a screen displayed on a display by a computer using a printer driver.

FIG. 10 is a view showing an example of a screen 1000 displayed on the display by the computer 220 using the printer driver.

As shown in FIG. 10, the computer 220 displays, on the display, a "Trial printing is possible" display 1001, a "normal toner" button 1002 and a "color fadable toner" button 1003 which are for selecting a developer, a "trial printing" button 1004 for performing trial printing, a "PRINT" button 1005 for instructing printing, and a "CANCEL" button 1006.

Figure 11:
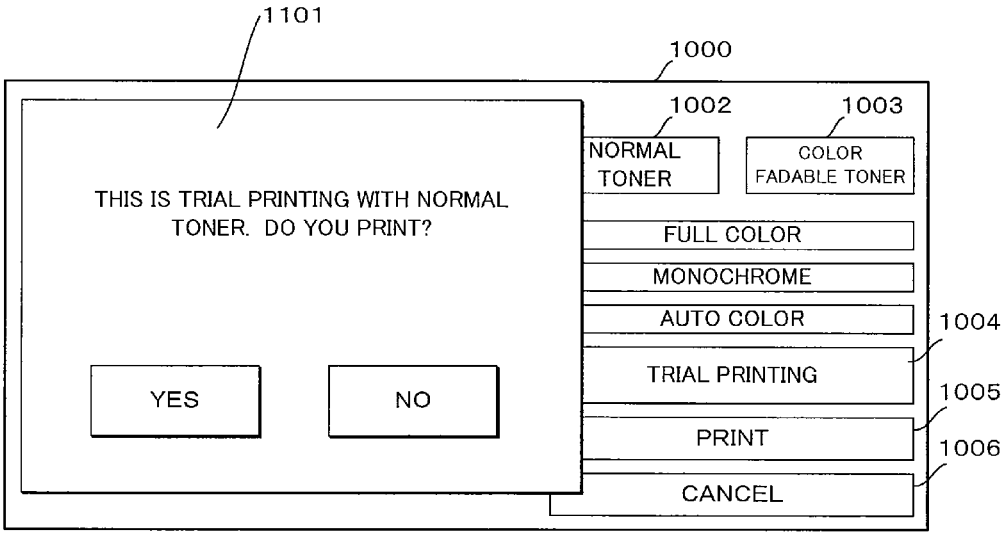
FIG. 11 is a view showing an example of a confirmation message displayed on the display by the computer.

FIG. 11 is a view showing an example of a confirmation message 1101 displayed on the display by the computer 220. As shown in FIG. 11, the computer 220 displays, on the display, a "YES" button, a "NO" button, a "This is trial printing with normal toner. Do you print?" as the confirmation message 1101 to confirm whether the execution of the trail printing with the color unerasable developer is allowed, and a "CANCEL" button 1006.

As described above, the image forming apparatus 1 of the embodiment includes the image forming part 13 to form an image with one of the color unerasable developer and the color erasable developer, and the control part 200 to automatically select the color erasable developer when the test printing is selected.

Accordingly, according to the image forming apparatus 1, there is an effect that when the test printing is performed, a user can be urged to use the color erasable developer more certainly.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An image forming apparatus for forming an image on a recording medium, comprising:

an image forming part to form the image on the recording medium with one of a color unerasable developer and a color erasable developer; and a control part to automatically select the color erasable developer as the developer used for test printing when an instruction of the test printing is received.

2. The apparatus of claim 1, further comprising:

an input and output part to display a test printing selection button to select the test printing, wherein the test printing is selected by the test printing selection button of the input and output part.

3. The apparatus of claim 2, wherein the input and output part displays a developer selection button to select one of the color erasable developer and the color unerasable developer, and the control part causes the input and output part to display a confirmation message to confirm whether execution of the test printing with the color unerasable developer is allowed when the test printing is selected by the test printing selection button and the color unerasable developer is selected as the developer used for the test printing by the developer selection button.

4. The apparatus of claim 3, wherein the control part causes the input and output part to display the confirmation message, a button to affirm confirmed content, and a button to negate the confirmed content, and the control part stops the test printing when the button to negate is selected through the input and output part.

5. The apparatus of claim 2, wherein the control part causes the input and output part to display a button to instruct the test printing with a test pattern.

6. The apparatus of claim 1, further comprising an interface to connect to an external apparatus, wherein when the control part receives a command indicating that the test printing is performed from the external apparatus through the interface, the control part performs the test printing in accordance with the command.

7. The apparatus of claim 6, wherein when the test printing is selected in the external apparatus, and the color unerasable developer is selected as the developer used for the test printing, the control part receives a command indicating that the test printing is performed with the color unerasable developer from the external apparatus through the interface, and the control part performs the test printing in accordance with the command.

8. The apparatus of claim 7, wherein when the control part determines that a start button is depressed after the test printing is performed, the control part performs a normal printing process.

9. An image forming method comprising:

automatically selecting a color erasable developer as a developer used for test printing when an instruction of the test printing is received.

10. The method of claim 9, further comprising:

displaying, on an input and output part, a test printing selection button to select the test printing; and selecting the test printing by the test printing selection button of the input and output part.

11. The method of claim 10, further comprising:

displaying, on the input and output part, a developer selection button to select one of the color erasable developer and a color unerasable developer; and displaying, on the input and output part, a confirmation message to confirm whether execution of the test printing with the color unerasable developer is allowed when the test printing is selected by the test printing selection button and the color unerasable developer is selected as the developer used for the test printing by the developer selection button.

12. The method of claim 11, further comprising:

displaying, on the input and output part, the confirmation message, a button to affirm confirmed content, and a button to negate the confirmed content; and stopping the test printing when the button to negate is selected through the input and output part.

13. The method of claim 12, further comprising:

displaying, on the input and output part, a button to instruct the test printing with a test pattern.

14. The method of claim 9, further comprising:

performing the test printing in accordance with a command when the command indicating that the test printing is performed is received from an external apparatus.

15. The method of claim 14, further comprising:

displaying a confirmation message when a color unerasable developer is selected after the test printing is selected in the external apparatus;

receiving, from the external apparatus, a command indicating that the test printing is performed with the color unerasable developer, when an instruction to affirm confirmed content is inputted; and performing the test printing in accordance with the command.

16. A non-transitory computer-readable medium having computer-executable instructions configured to perform a method comprising:

selecting whether image formation is performed on a recording medium with a developer selected between a color unerasable developer and a color erasable developer; and selecting the color erasable developer as the developer used for test printing when the test printing is selected.

17. The computer-readable medium of claim 16, wherein the method further comprises:

displaying, on an input and output part, a developer selection button to select one of the color erasable developer and the color unerasable developer; and displaying, on the input and output part, a confirmation message to confirm whether execution of the test printing with the color unerasable developer is allowed when the test printing and the color unerasable developer are selected by the input and output part.

18. The computer-readable medium of claim 17, wherein the method further comprises:

displaying, on the input and output part, the confirmation message, a button to affirm confirmed content, and a button to negate the confirmed content; and stopping the test printing when the button to negate is selected through the input and output part.

19. The computer-readable medium of claim 16, wherein the method further comprises:

performing the test printing in accordance with a command when the command indicating that the test printing is performed with the color erasable developer is received from an external apparatus.

20. The computer-readable medium of claim 19, wherein the method further comprises:

displaying a confirmation message to confirm whether execution of the test printing with the color unerasable developer is allowed, when the color unerasable developer is selected after the test printing is selected in the external apparatus;

receiving, from the external apparatus, a command indicating that the test printing is performed with the color unerasable developer, when an instruction to affirm confirmed content is inputted, and performing the test printing in accordance with the command.

* * * * *